US008035467B2

(12) United States Patent
Mittelstadt et al.

(10) Patent No.: US 8,035,467 B2
(45) Date of Patent: Oct. 11, 2011

(54) ADD-ON TRIP MODULE FOR MULTI-POLE CIRCUIT BREAKER

(76) Inventors: Chad R. Mittelstadt, Cedar Rapids, IA (US); Cameron Woodson, Cedar Rapids, IA (US)

( * ) Notice: Subject to any disclaimer, the term of this patent is extended or adjusted under 35 U.S.C. 154(b) by 411 days.

(21) Appl. No.: 12/327,323

(22) Filed: Dec. 3, 2008

(65) Prior Publication Data

US 2010/0134220 A1 Jun. 3, 2010

(51) Int. Cl.
*H01H 75/00* (2006.01)
*H01H 77/00* (2006.01)
*H01H 83/00* (2006.01)

(52) U.S. Cl. ..... 335/8; 335/6

(58) Field of Classification Search ..... 335/6, 8
See application file for complete search history.

(56) References Cited

U.S. PATENT DOCUMENTS 3,162,739 A * 12/1964 Klein et al. ..... 335/9
3,264,435 A * 8/1966 Klein et al. ..... 337/48
4,486,803 A 12/1984 Zylstra
4,719,438 A * 1/1988 Mrenna et al. ..... 335/38
4,931,757 A * 6/1990 Lemmer et al. ..... 335/131
5,670,922 A 9/1997 Montague et al.
6,144,271 A * 11/2000 Mueller et al. ..... 335/202
6,229,418 B1 * 5/2001 Mueller et al. ..... 335/202
6,239,677 B1 * 5/2001 Ramakrishnan et al. ..... 335/35
6,337,449 B1 1/2002 Brouillat et al.
7,323,956 B1 * 1/2008 Puskar et al. ..... 335/6
2001/0027961 A1 10/2001 Brouillat et al.
2007/0241846 A1 * 10/2007 Puskar et al. ..... 335/6

* cited by examiner

*Primary Examiner* — Elvin G Enad
*Assistant Examiner* — Alexander Talpalatskiy

(57) ABSTRACT

An add-on module adapted to be attached to the basic mechanical structure of a multi-pole circuit breaker includes multiple extended terminal plates each of which is adapted to replace one of the input and output terminals for one of the poles, multiple electromechanical transducers each of which is coupled to one of the extended terminal plates for producing a mechanical movement in response to a predetermined magnitude of electrical current in the extended terminal plate to which that transducer is coupled, and a mechanical actuator coupled to the electromechanical transducers and to the breaker contacts for operating a trip mechanism in response to a predetermined mechanical movement of any of the transducers.

17 Claims, 12 Drawing Sheets

ADD-ON TRIP MODULE FOR MULTI-POLE CIRCUIT BREAKER

FIELD OF THE INVENTION

The present invention relates to add-on modules for multi-pole circuit breakers and, more particularly, to an add-on trip module capable of utilizing the basic mechanical structure of a multiple-pole electronic-trip circuit breaker while replacing the electronic trip actuator with an electromechanical actuator.

BACKGROUND OF THE INVENTION

Multi-pole circuit breakers utilizing electronic actuators for actuating trip mechanisms in response to the detection of various types of fault conditions have become highly developed. The cost of these devices has been controlled in part by mass production of the basic mechanical structure of the breaker (sometimes referred to as the "platform" of the circuit breaker), as well as the electronic portions. These sophisticated circuit breakers, however, are not typically applicable to DC power systems, and available DC electronic trip units are very expensive because traditional current measurement transformers cannot generate their own power in a absence of alternating current, so they must use complex iron cores that move inside a wire bobbin at a set trip current level providing a one-time power generation to fire a solenoid, or an external power supply combined with a Hall effect sensor that can continuously monitor DC current levels.

SUMMARY OF THE INVENTION

In accordance with one embodiment, an add-on module is provided for the basic mechanical structure of a multiple-pole circuit breaker. The basic mechanical structure includes, for each pole:

- a power input terminal and a power output terminal,
- a pair of contacts each of which is connected to a different one of the terminals and at least one of which is movable,
- a trip mechanism coupled to the movable contact for opening the contacts by disengaging the movable contact from the other contact in the pair, and
- a manually operable actuator coupled to said movable contact for operating and resetting the trip mechanism.

The add-on module is adapted to be attached to the basic mechanical structure and includes:

- multiple extended terminal plates each of which is adapted to replace one of the terminals for one of the poles,
- multiple electromechanical transducers each of which is coupled to one of the extended terminal plates for producing a mechanical movement in response to a predetermined magnitude of electrical current in the extended terminal plate to which that transducer is coupled, and
- a mechanical actuator coupled to the electromechanical transducers and to the movable contacts for operating the trip mechanism in response to a predetermined mechanical movement of any of the transducers.

In one implementation, each of the electromechanical transducers comprises a stationary U-shaped electromagnet positioned directly adjacent one of the extended terminal plates, and a movable magnetizable element mounted adjacent the open end of the U-shaped electromagnet and mounted for movement in response to the electromagnetic field produced by a predetermined magnitude of electrical current in the extended terminal plate to which that transducer is coupled.

The add-on module permits the electronic sensing and trip-actuating portions of an electronic multi-pole circuit breaker to be easily replaced with an electromechanical sensing and trip-actuating device suitable for use with AC and DC power systems. The basic mechanical structure of the host circuit breaker used with the electronic actuator is used with the add-on module, thus taking advantage of the economics of mass production of that basic mechanical structure. The add-on module itself can be manufactured and assembled at a relatively low cost because it has a small number of parts that are easily assembled.

BRIEF DESCRIPTION OF THE DRAWINGS

The invention may best be understood by reference to the following description taken in conjunction with the accompanying drawings, in which.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to cover all alternatives, modifications, and equivalent arrangements as may be included within the spirit and scope of the invention as defined by the appended claims.

Figure 1:
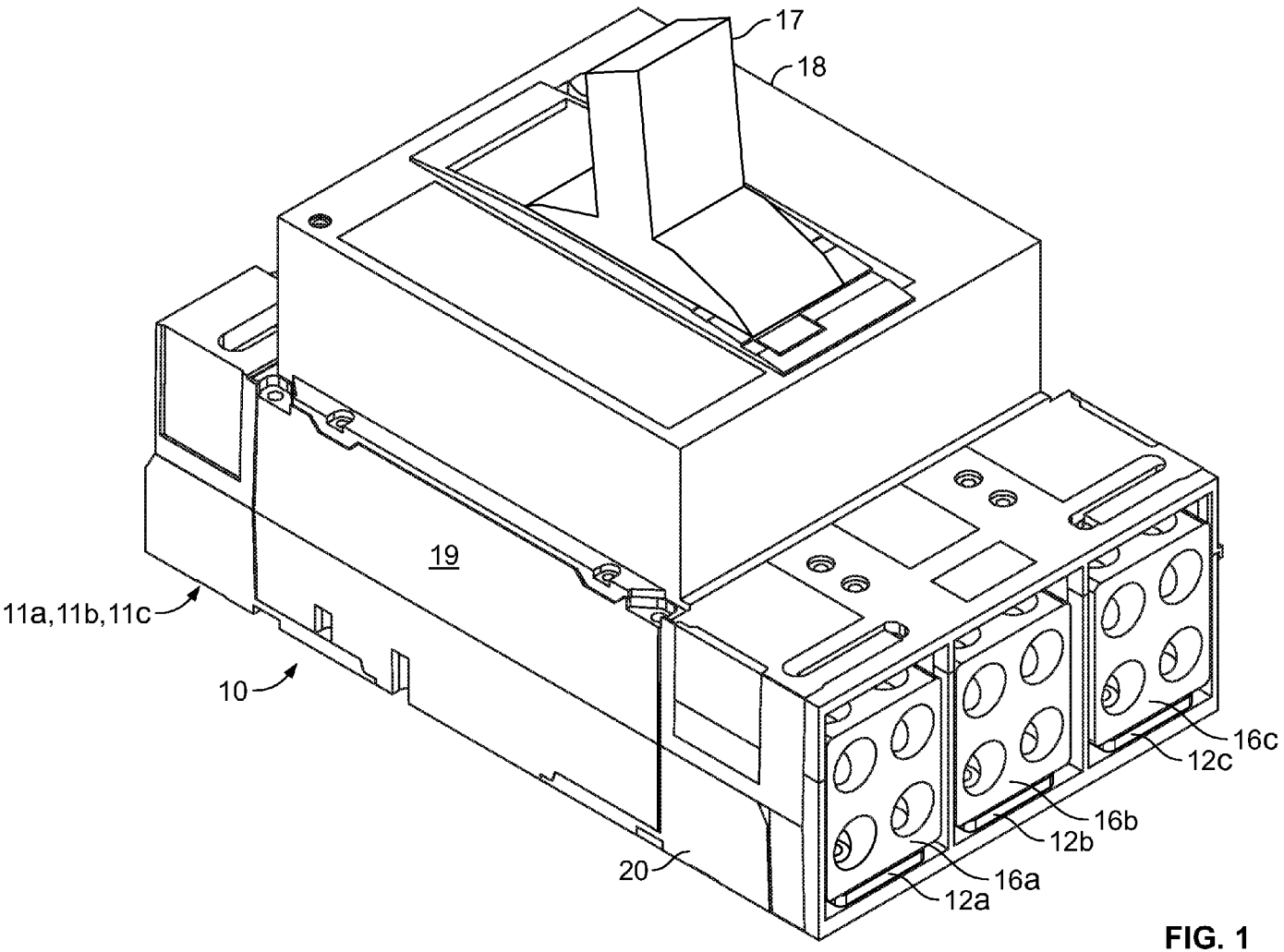
FIG. 1 is a perspective view of a multiple-pole circuit breaker equipped with an add-on module that includes a mechanical actuator for the trip mechanism in the basic mechanical structure of the breaker.
Figure 2:
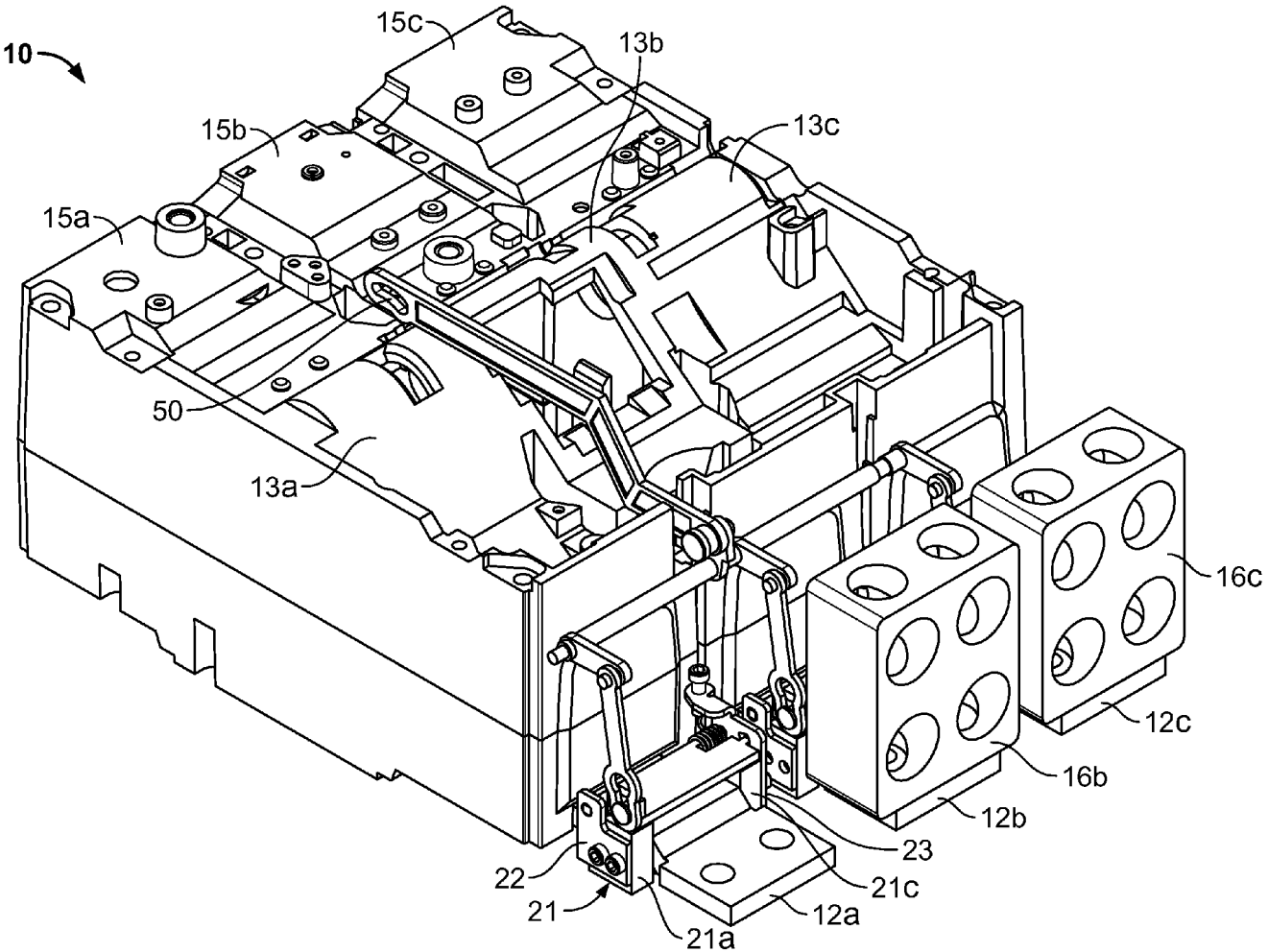
FIG. 2 is an enlarged perspective view of the basic mechanical structure of the circuit breaker of FIG. 1 with the housing removed and having an add-on module attached to one end of the basic mechanical structure.
Figure 3:
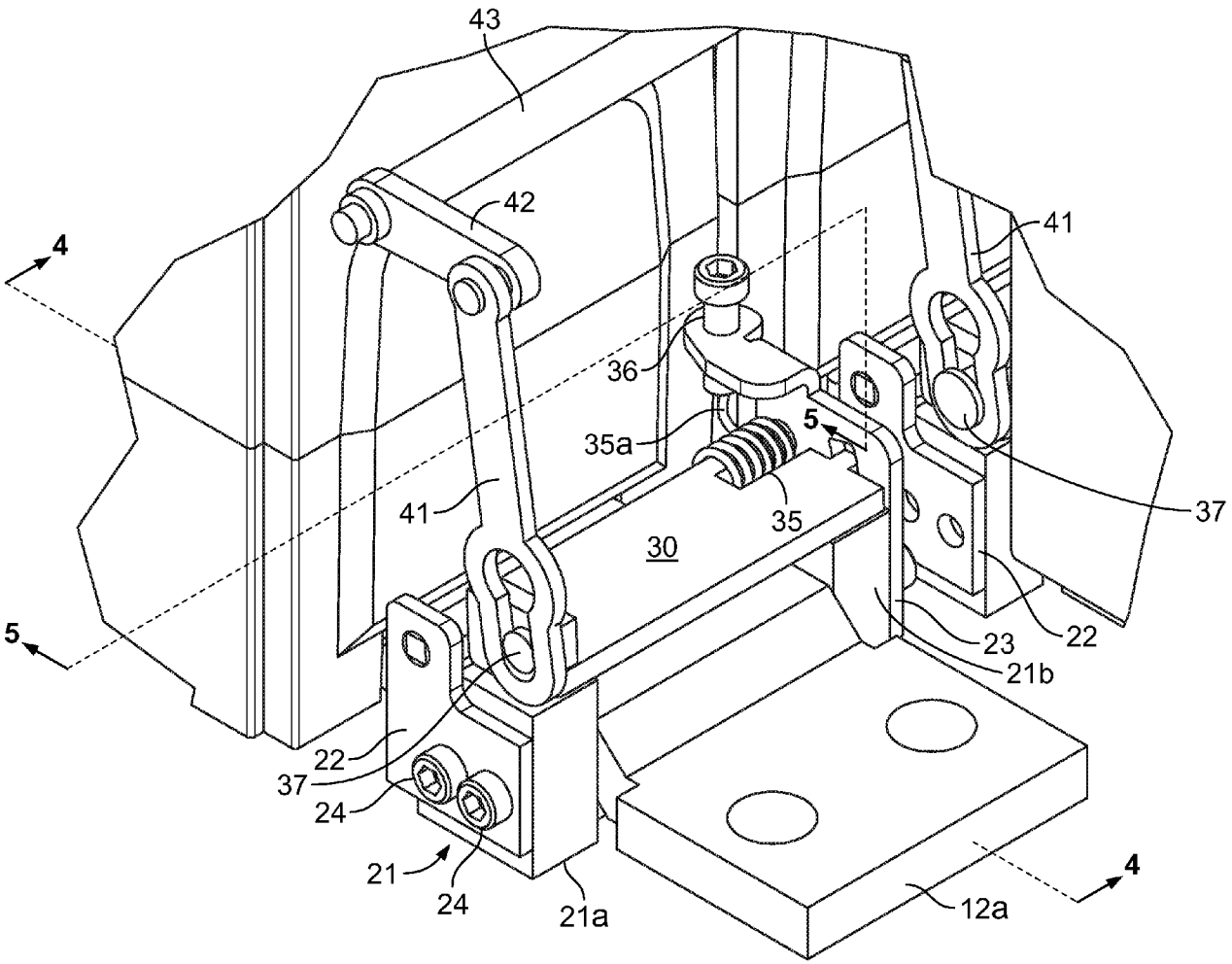
FIG. 3 is an enlarged perspective view of the lower front corner of the structure shown in FIG. 2.

Turning now to the drawings, FIGS. 1 and 2 illustrate a three-pole circuit breaker in which the basic mechanical structure 10 includes three power input terminals 11*a*-11*c*, three power output terminals 12*a*-12*c*, and three trip mechanisms 13*a*-13*c* for opening and closing three pairs of contacts, collectively 14*a*-14*c* (see FIGS. 9 and 10), connected to respective pairs of input and output terminals. Arc suppression chambers 15*a*-15*c* adjacent the three pairs of contacts dissipate and extinguish the arcs that occur when the breaker contacts are opened. Three lugs are positioned over each of the two sets of terminals, such as the lugs 16*a*-16*c* shown in FIGS. 1 and 2 over the output terminals 12*a*-12*c*.

A manually operated toggle 17 permits the breaker contacts to be opened and closed manually, and also permits the trip mechanisms 13*a*-13*c* to be simultaneously reset following a trip. The toggle 17 extends outwardly from an auxiliary housing 18 attached to a main body housing 19, which has been removed in FIG. 2. The mechanisms contained in the basic mechanical structure 10 of the illustrative host circuit breaker are well known and are described in numerous publications, such as U.S. Pat. No. 6,337,449 and U.S. Patent Application Publication No. US 2001/0027961 A1 assigned to the assignee of the present invention.

The basic mechanical structure 10 of the illustrative circuit breaker is capable of being tripped by an electronic trip system that includes at least three current sensors that produce signals related to the electrical current flowing between the input and output terminals 12*a*-12*c* when the breaker contacts are closed. These signals from the current sensors are supplied to a control circuit that uses the signals to detect the occurrence of a fault condition, and then produce an electrical trip signal when a fault condition is detected. The trip signal is typically supplied to one or more solenoids having armatures coupled to the trip mechanisms 13*a*-13*c* to open the three pairs of contacts 14*a*-14*c*. Such electronic trip systems are well known and are described in numerous publications, such as U.S. Pat. No. 4,486,803 assigned to the assignee of the present invention.

Figure 4:
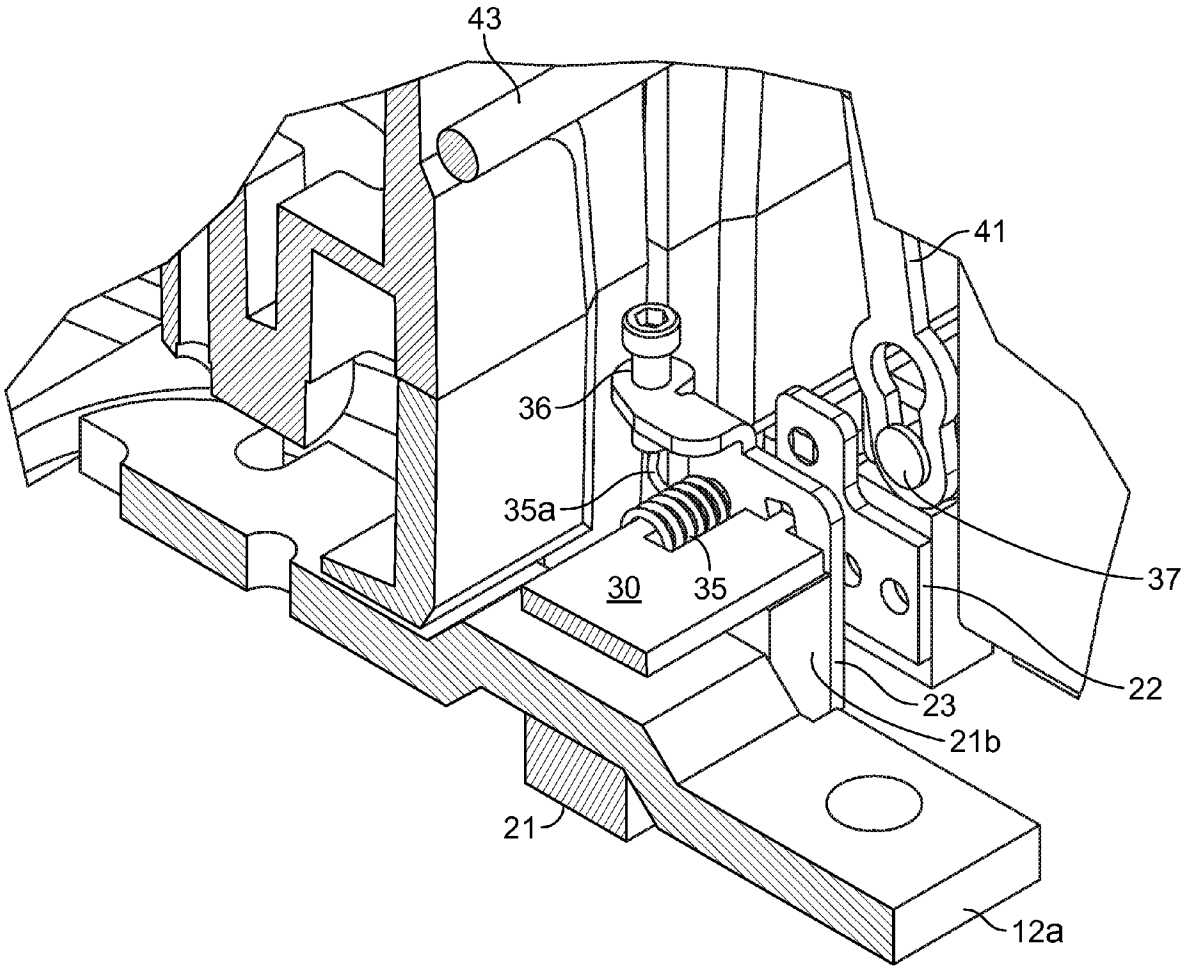
FIG. 4 is a sectional view of the structure shown in FIG. 3 taken along line 4-4 in FIG. 3.
Figure 5:
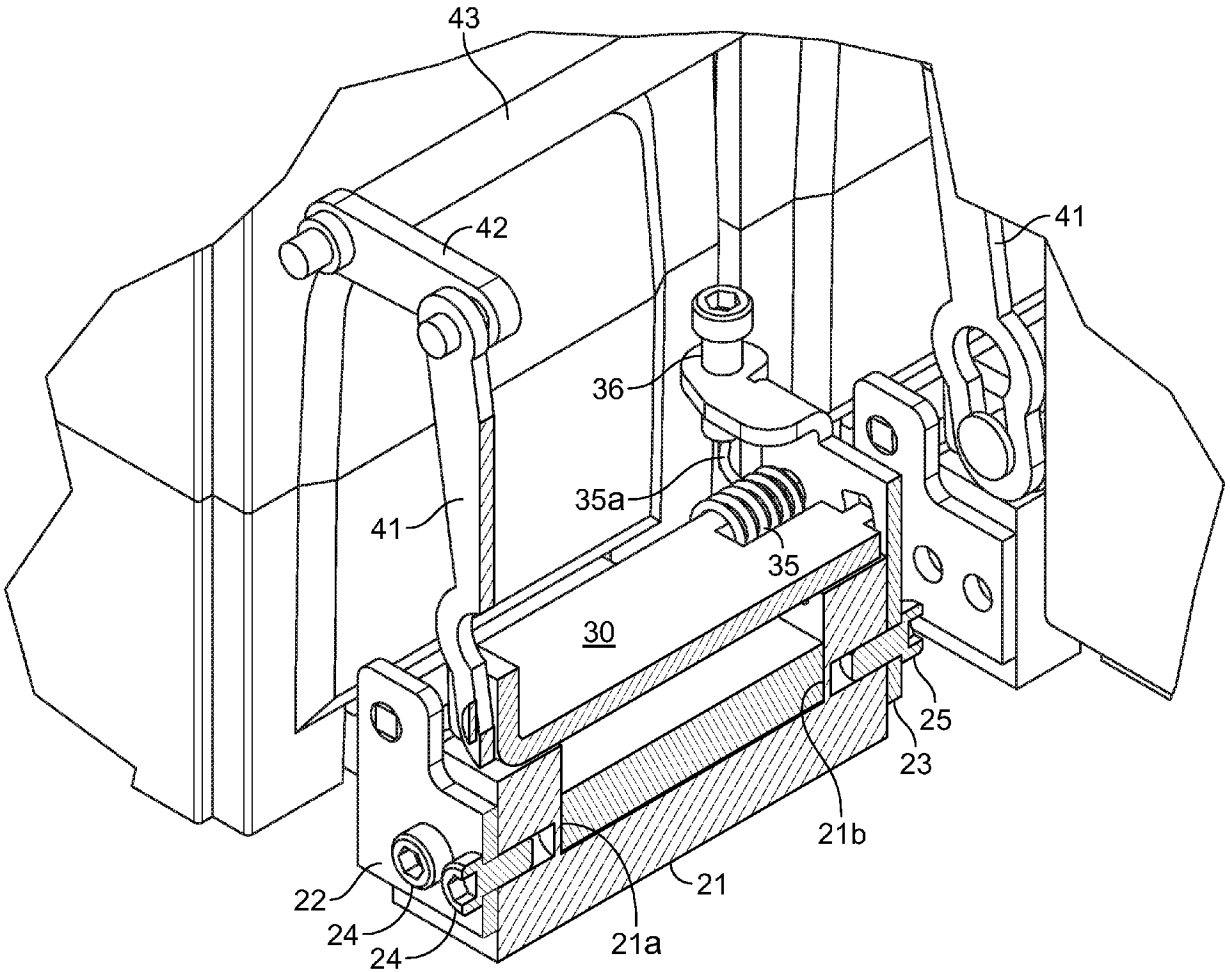
FIG. 5 is a sectional view of the structure shown in FIG. 3 sectioned along line 5-5 in FIG. 3.

To convert the circuit breaker from electronic actuation to mechanical actuation, an add-on module 20 is attached to one end of the basic mechanical structure 10. The module 20 bridges across the three output terminals 12*a*-12*c*, which are replacements for the input terminals normally used with the basic mechanical structure 10 of the illustrative host circuit breaker. The replacement terminals 12*a*-12*c* have increased lengths to accommodate the insertion of the module 20 between the basic mechanical structure 10 and the lugs 16*a*-16*c* used to attach power cables to the terminals. As can be seen in FIGS. 2 and 4, the extra length of each of the terminals 12*a*-12*c*, between the end wall of the basic mechanical structure 10 and the corresponding lug 16, is arched to allow the central portion of a stationary ferromagnetic element 21 to pass beneath the terminal.

The stationary ferromagnetic element 21 is part of an electromechanical transducer that produces mechanical movement in response to a predetermined magnitude of electrical current in the corresponding terminal 12 to which the transducer is coupled. In the illustrated embodiment, the stationary ferromagnetic element 21 is U-shaped with the two legs 21*a* and 21*b* of the U extending upwardly past the side edges of the underlying terminal 12. Two end plates 22 and 23 are attached to the outer surfaces of the legs 21*a* and 21*b*, respectively, with two pairs of screws 24 and 25. A magnetic flux is induced in the stationary ferromagnetic element 21 when electrical current passes through the corresponding terminal 12, and the strength of the magnetic flux varies as a function of the magnitude of the electrical current. For example, in the event of a short circuit, the current level in the terminal is very high and thus induces a large magnetic flux in the stationary ferromagnetic element 21. Three separate stationary ferromagnetic elements 21*a*-21*c* are coupled to the respective terminals 12*a*-12*c*. The magnetic flux increases rapidly to a saturation value as the electrical current in the terminals 12*a*-12*c* increases.

Figure 6:
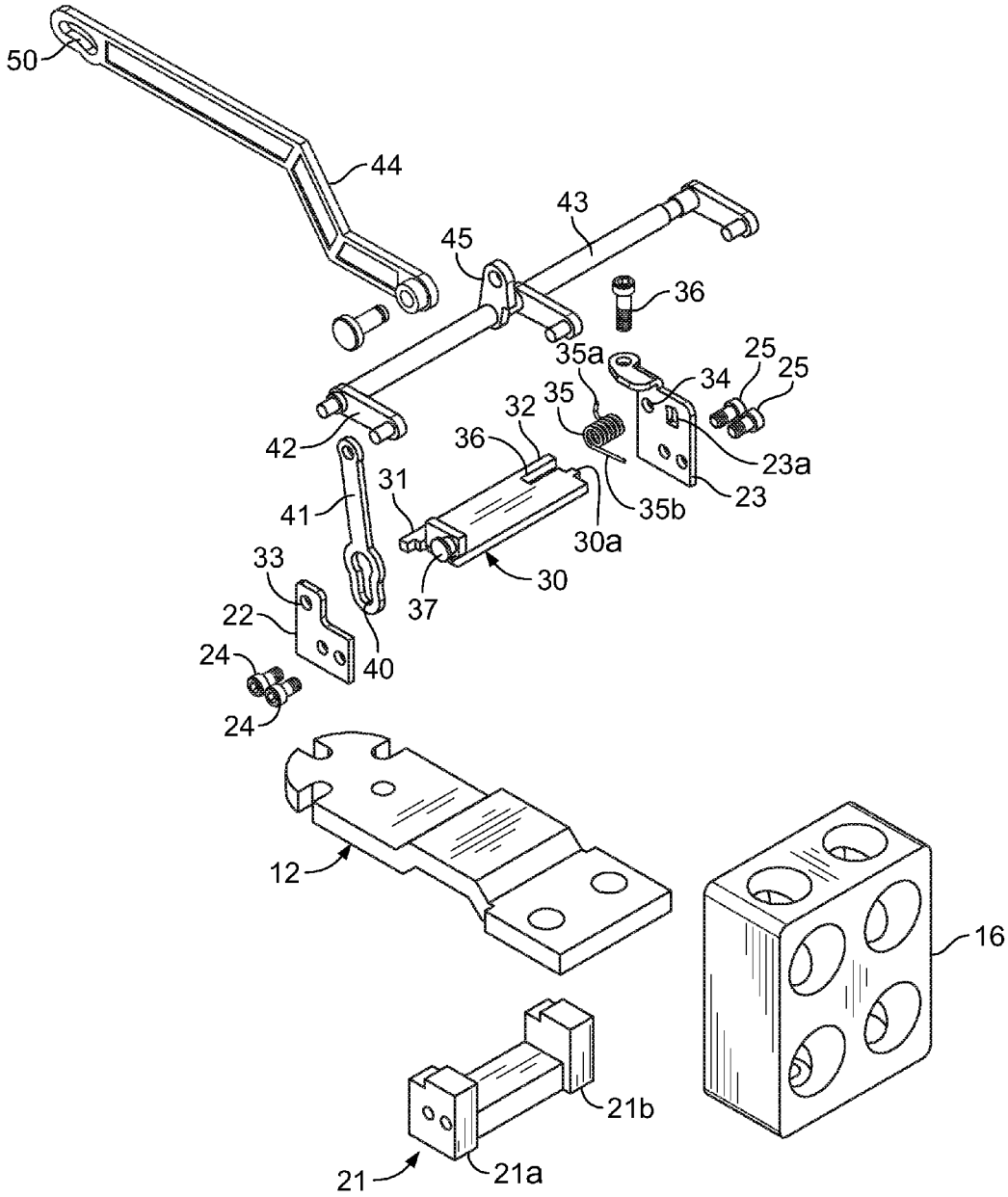
FIG. 6 is an exploded perspective of one of the electromechanical transducers and the mechanical actuator in the add-on module shown in FIG. 2.

Directly above the open end of each stationary ferromagnetic element 21, a movable rectangular ferromagnetic element 30 extends across the open end of the U and is pivotally mounted in the two end plates 22 and 23. Three separate movable ferromagnetic elements 30 are mounted above the respective stationary ferromagnetic elements 21*a*-21*c*. Each of the movable ferromagnetic elements 30 includes a pair of integral projections 31 and 32 (see FIG. 6) at opposite ends of one of the long edges of the movable element 30, and these projections 31 and 32 fit into mating holes 33 and 34 in the respective end plates 22 and 23 to allow pivoting movement of the element 30.

Each of the movable ferromagnetic elements 30 is biased upwardly by a separate torsion spring 35 that is slightly compressed by a calibration screw 36 engaging one end 35*a* of the spring 35. The other end 35*b* (see FIGS. 6-7C) of the spring 35 bears against the lower surface of the movable ferromagnetic element 30 to urge the free end of the movable ferromagnetic element 30 upwardly around the axis extending through the mounting holes 33 and 34. A slot 30*a* extends into the body of the ferromagnetic element 30 from the inner edge of the projection 32 to accommodate the spring 35, which is captured on the ferromagnetic element 30 by the end plate 23. When the current in the terminal increases to a predetermined threshold, the resulting magnetic flux in the stationary element 21 increases to a level that causes the free edge of the movable ferromagnetic element 30 to be drawn downwardly against the upward biasing force of the spring 35.

The calibration screw 36 permits manual adjustment of the resisting force of the biasing spring 35, thereby adjusting the predetermined magnitude of electrical current required to overcome the biasing force of the spring 35. As the calibration screw 36 is advanced downwardly against the end of the torsion spring 35, the upward spring force applied to the ferromagnetic element 30 is progressively increased because the amount of torque exerted by a torsion spring is proportional to the amount it is twisted. And increasing the spring force applied to the ferromagnetic element 30 increases the amount of current required to move the ferromagnetic element 30 and trip the breaker.

Figure 7A:
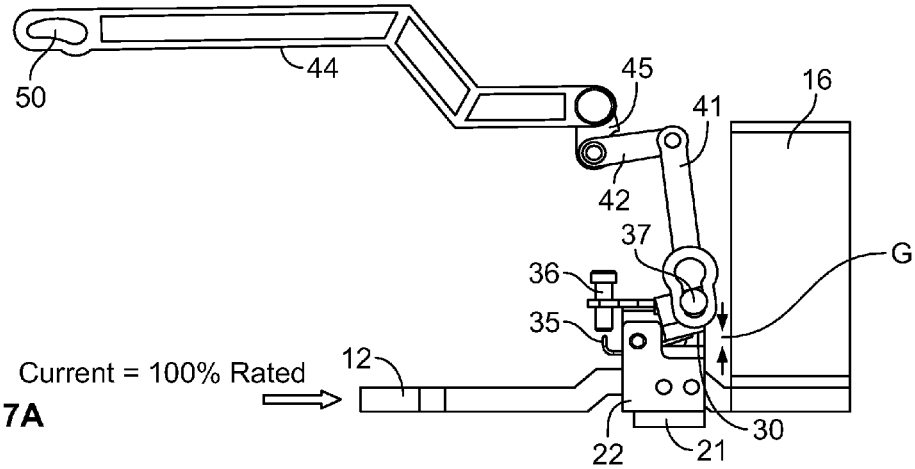
FIGS. 7A, 7B and 7C are side elevations of the add-on module of FIG. 2 in three different stages of operation.
Figure 7B:
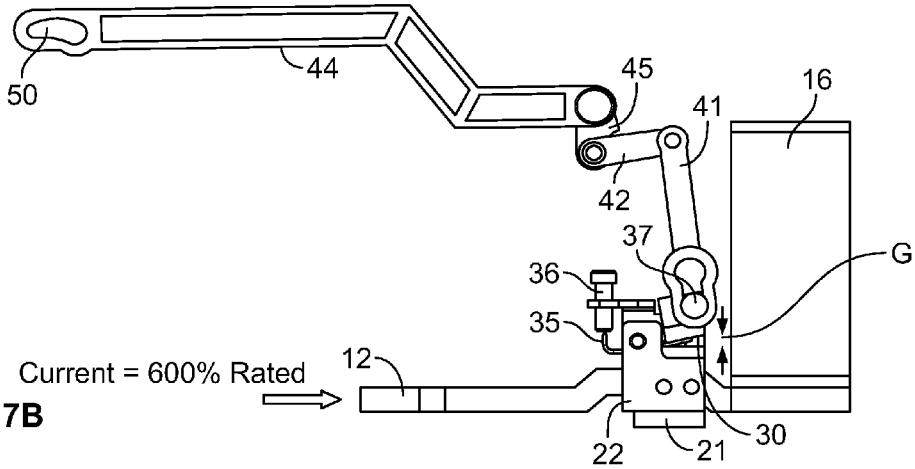
Figure 7C:
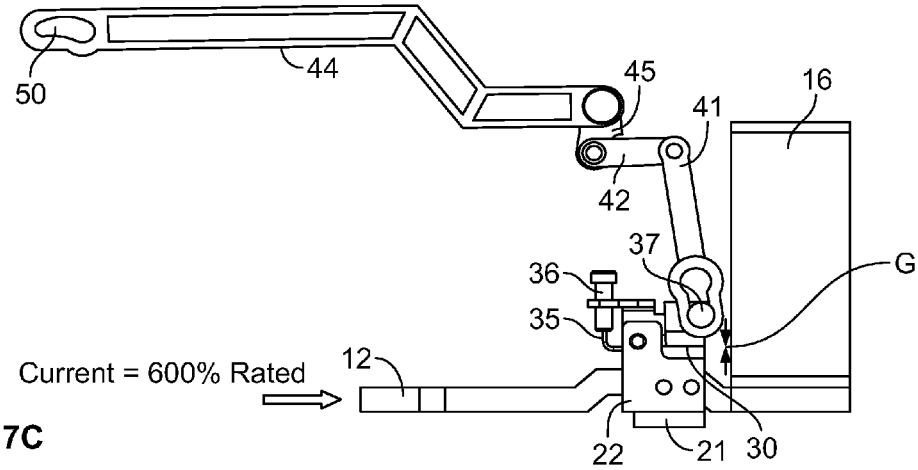

As can be seen in FIGS. 7A-7C, each movable ferromagnetic element 30 is biased toward its raised position, shown in FIG. 7A, by the torsion spring 35 mounted on the projection 32 of the element 30. This maximizes the air gap G between the lower surface of the movable ferromagnetic element 30 and the upper surfaces of the stationary ferromagnetic element 21. Upward movement of the element 30 is limited by engagement of an integral projection 30*a* with the upper end of a slot 23*a* in the end plate 23.

FIG. 7B illustrates the movable ferromagnetic element 30 beginning to pivot downwardly when the current passing through the terminal 12 reaches the threshold level. A pin 37 extending laterally from one end of the element 30 slides downwardly through a slot 40 in a link 41 until the pin 37 bottoms out at the lower end of the slot 40. Further downward movement of the movable ferromagnetic element 30 then pulls the link 41 downwardly, thereby pulling down one end of a link 42 attached to the upper end of the link 41. The other end of the link 42 is attached to a crossbar 43, which is rotated slightly (in a clockwise direction as viewed in FIG. 7B) by the movement of the link 42. This movement continues until the movable element 30 bottoms out on the upper surfaces of the stationary ferromagnetic element 21, as illustrated in FIG. 7C. Three separate links 41*a*-41*c* and 42*a*-42*c* are coupled to the respective movable ferromagnetic elements 30*a*-30*c*.

Rotational movement of the crossbar 43 is translated into linear movement of an elongated link 44 connected to the crossbar 43 by a short coupling link 45. The elongated link 44 extends across a major portion of the basic mechanical structure 10 and is attached at its far end to the same trip mechanism to which the solenoid armature is attached when an electronic actuator is used with the basic mechanical structure 10. Thus, movement of the elongated link 44 trips the host circuit breaker, in the same manner that movement of the solenoid armature trips the breaker with an electronic actuator.

The entire actuating mechanism between the movable ferromagnetic elements 30 and the trip mechanism of the host circuit breaker is preferably made of a non-conductive material, such as a polymeric material, to avoid any undesired induced currents or magnetic fluxes. The use of a polymeric material also permits a substantial portion of the actuator to be molded as a single piece, e.g., the crossbar 43 and the links 42, 44 and 45.

Figure 8:
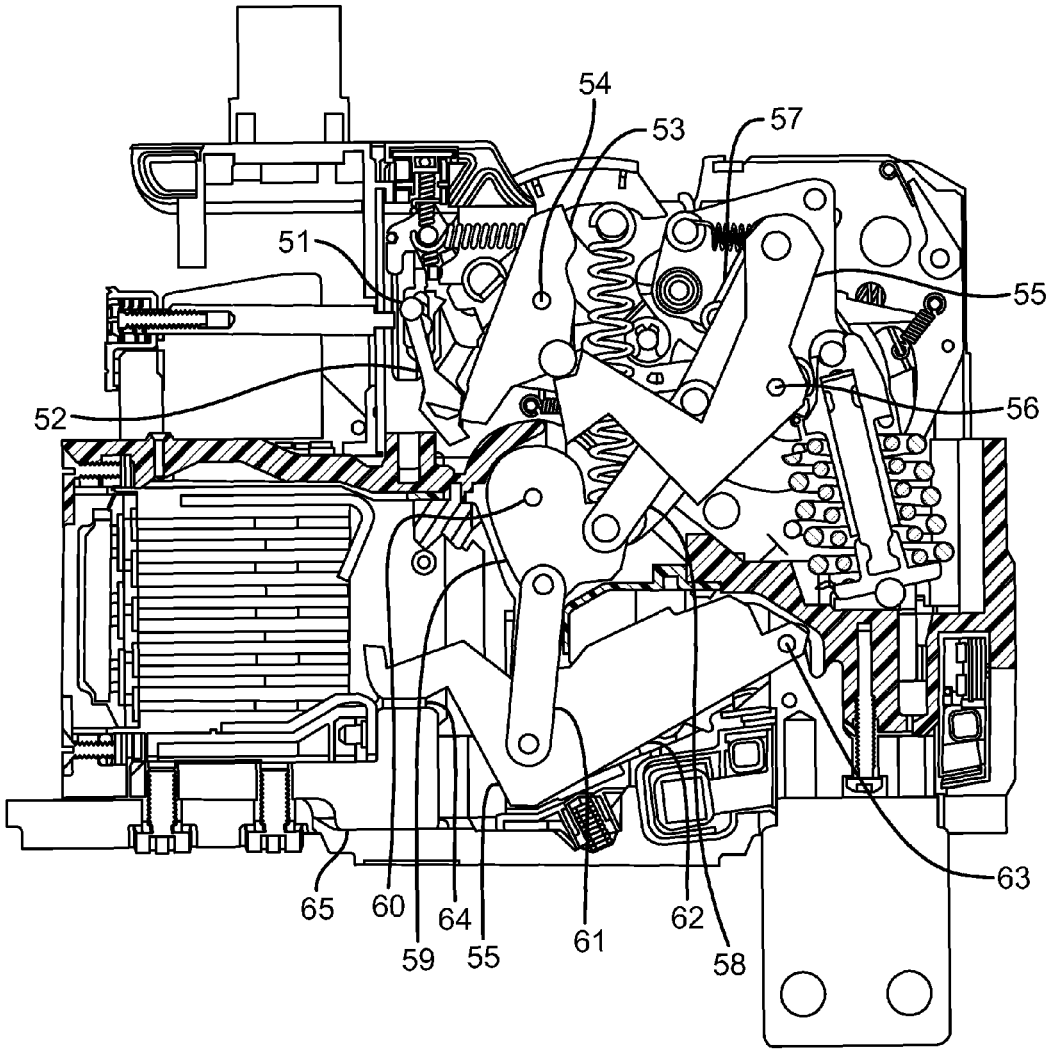
FIG. 8 is a side elevation of the basic mechanical structure of a host multi-pole circuit breaker operated by the actuator of the add-on module shown in FIG. 2.
Figure 9:
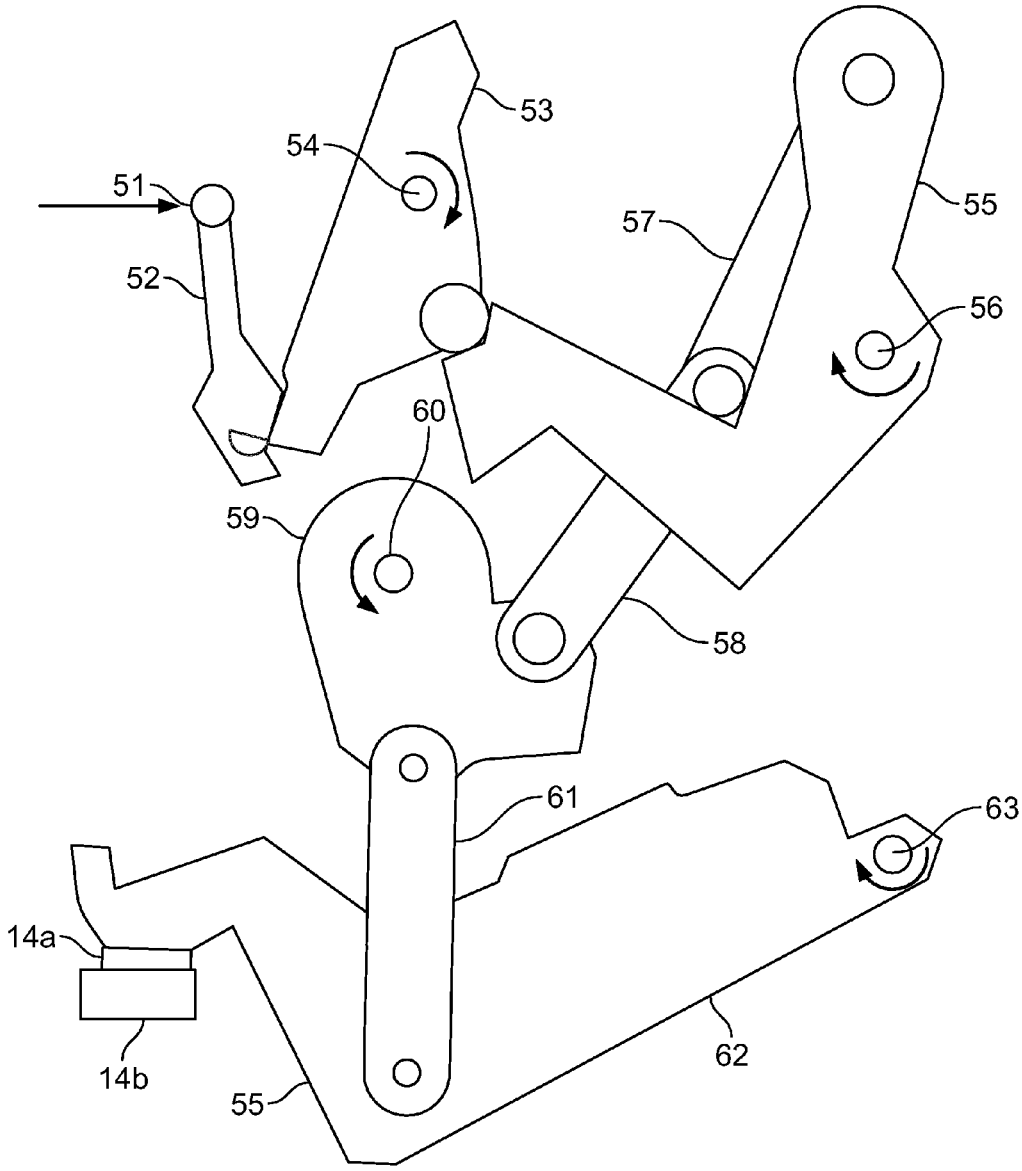
FIGS. 9 and 10 are side elevations of the main components of the basic mechanical structure shown in FIG. 8, in two different stages of operation.
Figure 10:
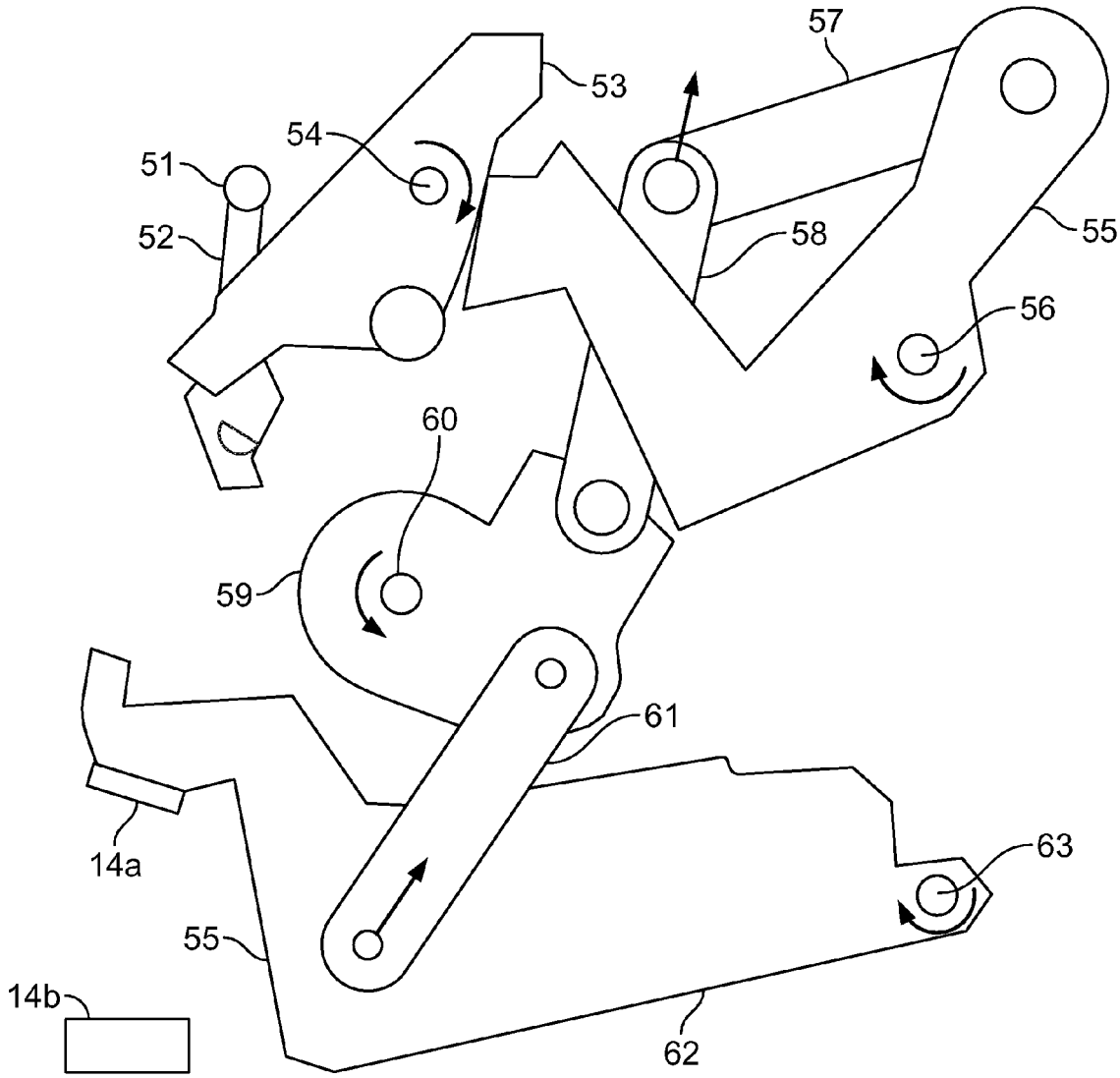

FIGS. 8-10 illustrate the main components of the basic mechanical structure 10 that opens the contacts in the host circuit breaker in response to the mechanical movement of the elongated actuating link 44. FIGS. 8 and 9 illustrate the basic mechanical structure in the ON condition, i.e., with the breaker contacts 14*a*, 14*b* closed, and FIG. 10 illustrates the same structure in the TRIPPED condition, i.e., with the breaker contacts 14*a*, 14*b* open. Portions of this basic mechanical structure are described and illustrated in U.S. Pat. No. 6,337,449 assigned to the assignee of the present invention.

The distal end of the link 44 forms an elongated slot 50 that receives a laterally projecting pin 51 on the end of a latch bar 52 in the host breaker. The latch bar 52 pivots when the pin 51 is pulled toward the add-on module by movement of the link 44 to the left as viewed in FIG. 7-9. This pivoting movement of the latch bar 52 releases a latch plate 53 that is spring-biased to pivot in a clockwise direction (as viewed in FIG. 9) around an axis 54, which in turn allows a spring-biased hook plate 55 to pivot in a clockwise direction (as viewed in FIG. 9) around an axis 56. The pivoting movement of the hook plate 55 causes an upper link 57 attached to the upper end of the hook plate to pivot in a clockwise direction (as viewed in FIG. 9) with the hook plate, thereby raising a lower link 58 that connects the lower end of the upper link to a pole bar 59. The upward movement of the lower link 58 turns the pole bar 59 around an axis 60 in a counterclockwise direction (as viewed in FIG. 9), thereby raising a pole link 61. The upward movement of the pole link 61 pivots a pole 62 in a clockwise direction (as viewed in FIG. 9) around an axis 63. The pole 62 carries the movable contact 14*a*, and the pivoting clockwise movement of the pole 62 raises the contact 14*b* to separate it from a mating stationary contact 14*b*. Thus, the mechanical movement of the actuating link 4 is translated into pivoting movement of the movable contact 14*a* away from the stationary contact 14*b* in each of the three poles, thereby opening the breaker.

The add-on module described above permits the electronic sensing and trip-actuating portions of an electronic multipole circuit breaker to be easily replaced with an electromechanical sensing and trip-actuating device suitable for use with AC and DC power systems. The basic mechanical structure of the host circuit breaker used with the electronic actuator is still used with the add-on module, thus taking advantage of the economics of mass production of that basic mechanical structure. The add-on module itself can be manufactured and assembled at a relatively low cost because it has a small number of parts that are easily assembled.

Figure 11:
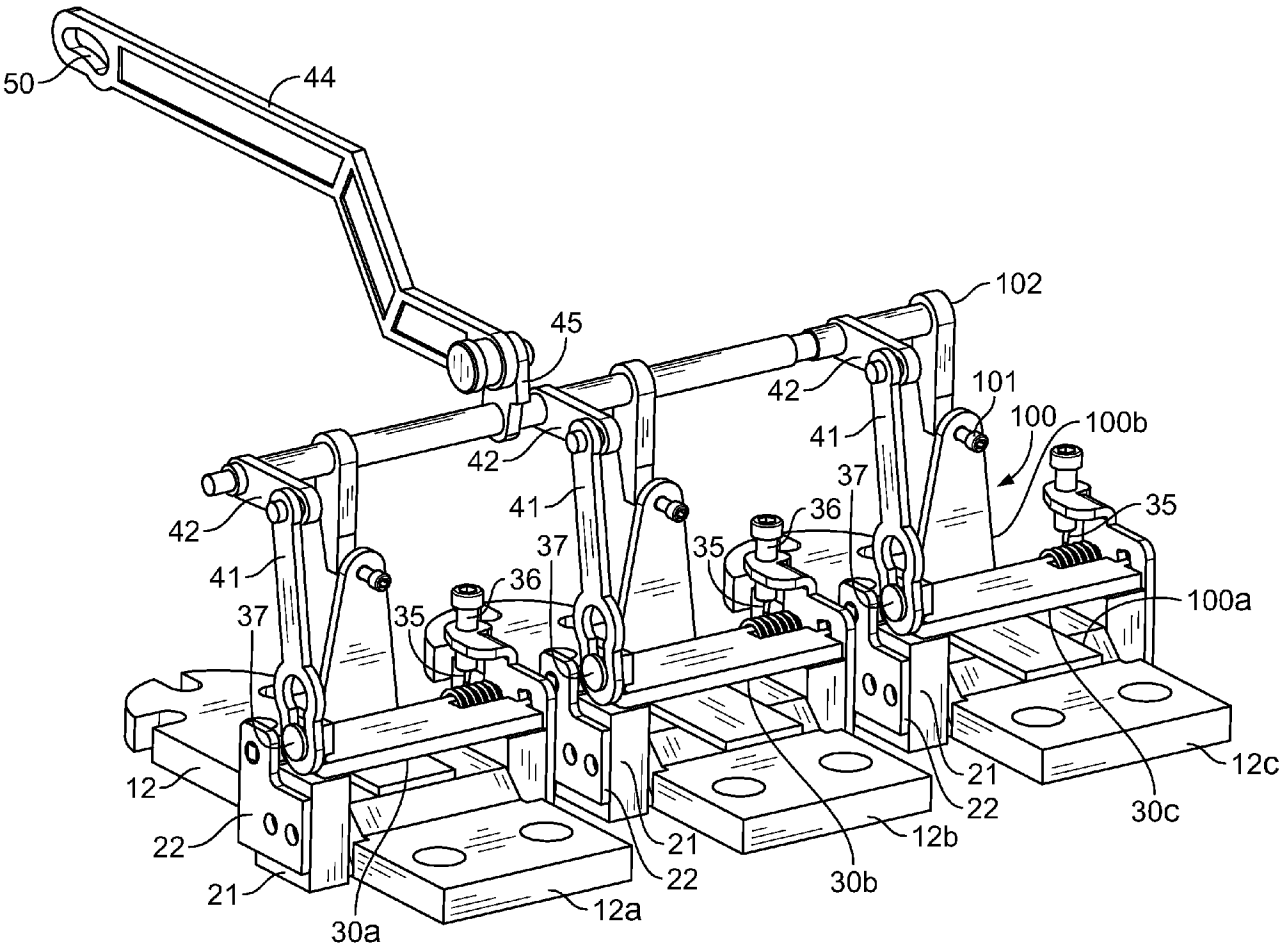
FIG. 11 is a perspective view of a modified add-on module that includes a second type of electromechanical transducer utilizing a bimetallic element.
Figure 12A:
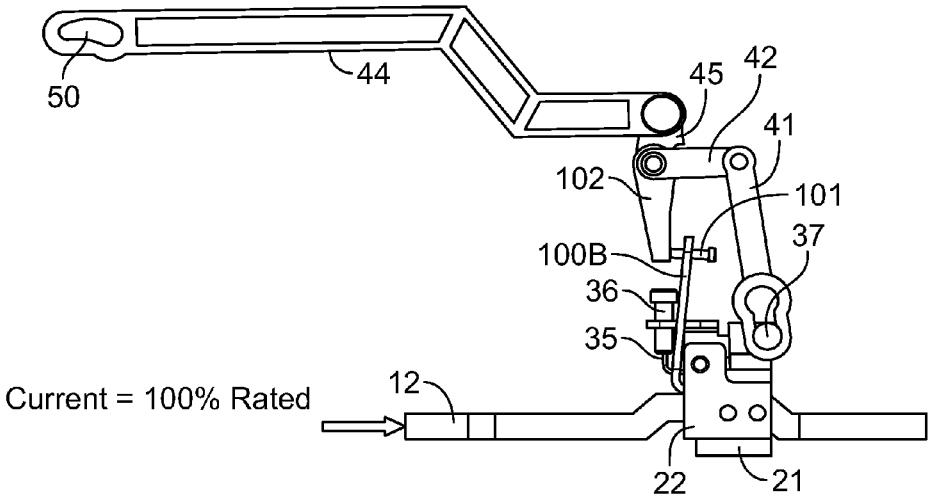
FIGS. 12A and 12B are side elevations of the structure shown in FIG. 11 in two different stages of operation.
Figure 12B:
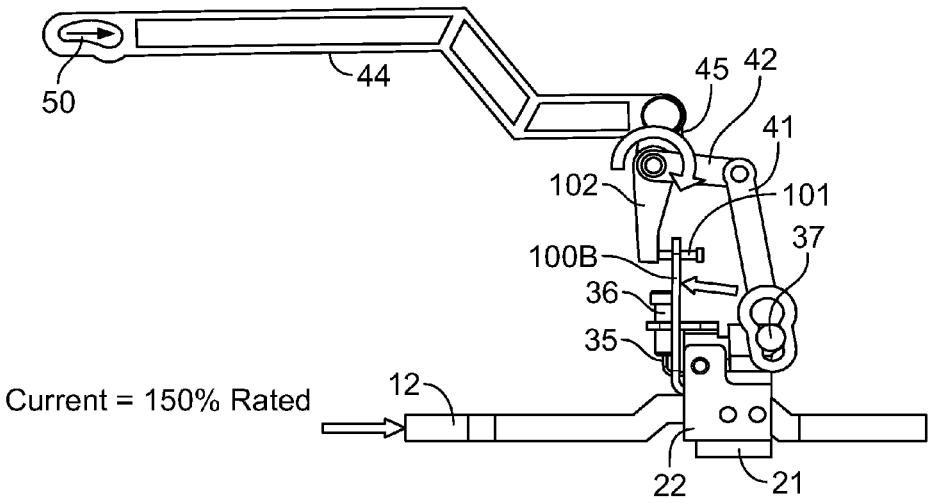

FIGS. 11, 12A and 12B illustrate a modified add-on module for effecting a thermal trip. In this modified embodiment, each of the output terminals 12*a*-12*c* is coupled to a second electromechanical transducer that actuates the trip mechanism by turning the crossbar 43 in response to a temperature change produced by an electrical current above a predetermined level. As further discussed below, each transducer includes a temperature-responsive thermomechanical element, such as a bimetal, that is heated by the electrical current in the terminal and produces mechanical movement that is related to the temperature of the temperature responsive element.

In the illustrated embodiment, the temperature-responsive elements are three L-shaped bimetallic elements 100 attached to the upper surfaces of the respective terminals 12*a*-12*c*. One leg 100B of each L-shaped bimetallic element 100 extends upwardly away from the corresponding terminal 12, with the free end of that leg 100B carrying a screw 101 that engages a link 102 attached to the crossbar 43. As the bimetal is heated, the leg 100B bows because of the differential thermal expansion of the two different metals. This bowing deflects the free end of the leg 100B and its screw 101 against the link 102, thereby causing rotational displacement of the crossbar 43. As already described, rotational movement of the crossbar 43 is translated into linear movement of an elongated link 44 to actuate the trip mechanism in the host breaker. The screw 101 can be adjusted in relation to the link 102 to change the amount of bowing of the bimetallic element 100 required to effect a trip. It will be appreciated that either the transducers utilizing the bimetallic elements 100 or the transducers utilizing the ferromagnetic elements 21 and 30 may move the crossbar independently of each other to cause a trip.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A multiple-pole circuit breaker comprising a basic mechanical structure that includes, for each pole, a power input terminal and a power output terminal, a pair of contacts each of which is connected to a different one of said terminals and at least one of which is movable, a trip mechanism coupled to said movable contact for opening said contacts by disengaging said movable contact from the other contact in said pair, an electronic trip system that includes a plurality of current sensors producing signals related to the electrical current flow between said power input and output terminals, and a control circuit receiving said signals, detecting the occurrence of a fault condition, and producing an electrical trip signal when a fault condition is detected, a solenoid receiving said trip signal and coupled to said trip mechanism for moving said trip mechanism to open said contacts in response to said trip signal, and a manually operable actuator coupled to said movable contact for operating and resetting said trip mechanism, and an add-on module adapted to be attached to said basic mechanical structure and including multiple extended terminal plates each of which is adapted to replace one of said terminals for one of said poles, multiple electromechanical transducers each of which is coupled to one of said extended terminal plates for producing a mechanical movement in response to a predetermined magnitude of electrical current in the extended terminal plate to which that transducer is coupled, and a mechanical actuator coupled to said electromechanical transducers and to said movable contacts for operating said trip mechanism in response to a predetermined movement of any of said transducers.

2. The multiple-pole circuit breaker of claim 1 in which each of said electromechanical transducers includes a ferromagnetic element adjacent one of said terminals for generating a magnetic flux having a strength related to the magnitude of electrical current passing through said adjacent terminal.

3. The multiple-pole circuit breaker of claim 1 in which each of said electromechanical transducers comprises a stationary U-shaped ferromagnetic element positioned directly adjacent one of said extended terminal plates, and a movable ferromagnetic element mounted adjacent the open end of said U-shaped element and mounted for movement in response to said magnetic flux generated by a predetermined magnitude of electrical current in the extended terminal plate to which that transducer is coupled.

4. The multiple-pole circuit breaker of claim 1 in which each of said electromechanical transducers comprises a thermomechanical element attached to one of said extended terminal plates for producing a mechanical displacement in response to the heating of said thermomechanical element by electrical current in the extended terminal plate to which that transducer is attached.

5. The multi-pole circuit breaker of claim 4 in which said thermomechanical element is a bimetal.

6. The multi-pole circuit breaker of claim 4 in which said thermomechanical element produces said mechanical displacement in response to the heating of said thermomechanical element by a predetermined magnitude of electrical current in the extended terminal plate to which that transducer is attached.

7. The multiple-pole circuit breaker of claim 1 which includes a biasing spring resisting said mechanical movement until said electrical current in said extended terminal plate to which that transducer is coupled is increased to a predetermined level, and an adjustment device coupled to said biasing spring for adjusting the resisting force of said biasing spring and thereby adjusting said predetermined magnitude of electrical current at which said mechanical movement is produced.

8. The multiple-pole circuit breaker of claim 1 which includes a calibration element for adjusting said predetermined magnitude of electrical current at which said mechanical movement is produced by each of said transducers.

9. An add-on module for activating a trip mechanism of a circuit breaker for a multi-phase electrical power distribution system, said circuit breaker having multiple terminal plates each of which is adapted to be electrically connected to one of the multiple phase lines, a pair of fixed and movable contacts for each of the multiple phases, a trip mechanism for moving said movable contacts to open and close the phase lines, an electronic trip system that includes a plurality of current sensors producing signals related to the electrical current flow in said phase lines, a control circuit receiving said signals, detecting the occurrence of a fault condition, and producing an electrical trip signal when a fault condition is detected, and a solenoid receiving said trip signal and coupled to said trip mechanism for moving said trip mechanism to open said contacts in response to said trip signal, said module comprising:

multiple extended terminal plates each of which is adapted to replace one of said terminals for one of said phase lines, multiple electromechanical transducers each of which is coupled to one of said extended terminal plates for producing a mechanical movement in response to a predetermined magnitude of electrical current in the extended terminal plate to which that transducer is coupled, and a mechanical actuator coupled to said electromechanical transducers and to said movable contacts for operating said trip mechanism in response to a predetermined movement of any of said transducers.

10. The add-on module of claim 9 in which said multiple electromechanical transducers comprise multiple stationary ferromagnetic elements each of which is coupled to one of said terminal plates to produce a magnetic flux having a strength related to the magnitude of the electrical current in the corresponding terminal plate, and multiple movable ferromagnetic elements each of which is mounted adjacent one of said stationary ferromagnetic elements for movement in response to a preselected change in the magnetic flux produced by the corresponding stationary ferromagnetic element.

11. The multiple-pole circuit breaker of claim 9 in which each of said electromechanical transducers includes a ferromagnetic element adjacent one of said terminals for generating a magnetic flux having a strength related to the magnitude of electrical current passing through said adjacent terminal.

12. The multiple-pole circuit breaker of claim 9 in which each of said electromechanical transducers comprises a stationary U-shaped ferromagnetic element positioned directly adjacent one of said extended terminal plates, and a movable ferromagnetic element mounted adjacent the open end of said U-shaped element and mounted for movement in response to said magnetic flux generated by a predetermined magnitude of electrical current in the extended terminal plate to which that transducer is coupled.

13. The multiple-pole circuit breaker of claim 9 in which each of said electromechanical transducers comprises a thermomechanical element attached to one of said extended terminal plates for producing a mechanical displacement in response to the heating of said thermomechanical element by electrical current in the extended terminal plate to which that transducer is attached.

14. The multi-pole circuit breaker of claim 13 in which said thermomechanical element is a bimetal.

15. The multi-pole circuit breaker of claim 13 in which said thermomechanical element produces said mechanical displacement in response to the heating of said thermomechanical element by a predetermined magnitude of electrical current in the extended terminal plate to which that transducer is attached.

16. The multiple-pole circuit breaker of claim 9 which includes a biasing spring resisting said mechanical movement until said electrical current in said extended terminal plate to which that transducer is coupled is increased to a predetermined level, and an adjustment device coupled to said biasing spring for adjusting the resisting force of said biasing spring and thereby adjusting said predetermined magnitude of electrical current at which said mechanical movement is produced.

17. The multiple-pole circuit breaker of claim 9 which includes a calibration element for adjusting said predetermined magnitude of electrical current at which said mechanical movement is produced by each of said transducers.

* * * * *